United States Patent [19]

Chapman

[11] Patent Number: 4,700,449

[45] Date of Patent: Oct. 20, 1987

[54] APPARATUS FOR ASSEMBLING SPEED LACERS

[75] Inventor: Wayne M. Chapman, West Greenwich, R.I.

[73] Assignee: Rau Fasteners Inc., Providence, R.I.

[21] Appl. No.: 819,108

[22] Filed: Jan. 14, 1986

[51] Int. Cl.[4] ..... A41H 37/02

[52] U.S. Cl. ..... 29/513; 29/512; 29/33 K; 29/432.1; 29/709; 29/714; 227/27

[58] Field of Search ..... 29/33 K, 512, 513, 708, 29/709, 714, 432.1; 227/27

[56] References Cited

FOREIGN PATENT DOCUMENTS 0584229 9/1933 Fed. Rep. of Germany ..... 227/27

2504363 4/1981 France ..... 227/27

*Primary Examiner*—Howard N. Goldberg

*Assistant Examiner*—Taylor J. Ross

*Attorney, Agent, or Firm*—Salter & Michaelson

[57] ABSTRACT

A method and apparatus for assembling speed lacers on sheets, such as the lacing strips of boots, wherein the speed lacers are of generally U-shaped configuration and each comprises an arch-shaped end portion and a pair of spaced legs which extend therefrom terminating in apertures clamping discs. The apparatus comprises an assembly unit comprising a movable die assembly, a stationery die assembly, a punch assembly, a feed finger, a feed block, and a positioning pin. During operation of the apparatus in accordance with the method, a speed lacer is advanced through a channel in the feed block with the feed finger and received on the positioning pin adjacent the forward end of the channel, and the clamping discs of the speed lacer are engaged by dies of the die assemblies to deform the speed lacer to a clamping position wherein the clamping discs thereof clampingly engage the sheet. Thereafter, while the dies are still in engagement with the clamping discs, the punch assembly, which is operative through the center of one of the dies, punches an aperture in the sheet which is aligned with the apertures in the clamping discs.

10 Claims, 9 Drawing Figures

APPARATUS FOR ASSEMBLING SPEED LACERS

BACKGROUND AND SUMMARY OF THE INVENTION

The instant invention relates to fastener attaching machines and more particularly to an apparatus for assembling speed lacers on sheet materials such as those used in the manufacture of boots, shoes and the like.

It has been found that for certain types of footwear, such as work boots, combat boots and the like, it is desirable to provide lacing assemblies which can be quickly and easily manipulated for securing the footwear on the feet of wearers thereof. In this connection, it has been found that the use of speed lacers which provide inwardly projecting loop-shaped lacing eyelets along the front lacing portions or strips of boots for receiving lacers therethrough can be utilized for providing highly effective lacing assemblies which are rapidly operable for securing footwear on the feet of wearers. Speed lacers are normally formed in generally U-shaped configurations, and they generally each comprise an arch-shaped end portion and a pair of spaced legs which extend therefrom terminating in spaced, substantially parallel apertured clamping discs. A speed lacer of this type is assembled on the lacing portion or strip of a boot by first positioning the speed lacer so that the clamping discs thereof are disposed adjacent opposite sides of the lacing strip and so that the arch-shaped end portion and the legs of the speed lacer project outwardly from the adjacent edge of the lacing strip to define a loop therealong. A pair of opposed dies are then operated at a first work station so that they engage the clamping discs of the speed lacer to deform it to a clamping position wherein the clamping discs thereof are in clamping engagement with opposite sides of the lacing strip. Thereafter, the dies are disengaged from the clamping discs, and a punch is operated at a second work station for punching an aperture in the lacing strip which is aligned with the apertures in the clamping discs. The punch is then removed from the speed lacer, and the speed lacer is riveted to the lacing strip at a third word station by means of a rivet which extends through the apertures in the clamping discs of the speed lacer. While this general procedure for assembling speed lacers on the lacing strips of boots and the like has been automated to some extent, it has generally required at least three separate operations at three separate work stations for each speed lacer; and hence this procedure for assembling and punching speed lacers has been relatively time consuming and costly. While other apparatus have been heretofore available which have been operative for assembling speed lacers on sheets at single work stations, they have not been operative for both assembling speed lacers and for punching apertures in the sheets with punches; but instead they have required the use of one-piece, self-punching rivets for securing the speed lacers on the sheets. In this connection, it has generally be found that one-piece, self-punching rivets are less than entirely effective for permanently securing speed lacers on sheets, such as the lacing strips of boots, where they are likely to receive harsh service.

The instant invention provides a highly-effective method and apparatus for assembling a speed lacer on a sheet, such as a lacing strip of a boot. More specifically, the apparatus of the instant invention comprises means for receiving and positioning a speed lacer in an aligned position at a work station, first and second die means engageable with the clamping discs of the speed lacer for urging the clamping discs together so that the speed lacer is deformed to a clamping position, wherein when a sheet is received between the clamping discs, the clamping discs clampingly engage opposite sides of the sheet, and punch means operative through the first die means for punching an aperture in the sheet which is aligned with the apertures in the clamping discs when the first and second die means are in engagement with the clamping discs and the clamping discs are in the clamping position on the sheet. The preferred embodiment of the apparatus further comprises an elongated feed block having a feed channel therein which terminates adjacent the work station, and a feed finger which is slidably received in the feed channel for advancing speed lacers to the work station. The means for positioning a speed lacer at the work station preferably comprises a positioning pin which is disposed in substantially transverse relation to the feed channel adjacent the work station, and the feed finger is operative for feeding a speed lacer to the work station so that it is received on the positioning pin, and for engaging the speed lacer to urge the inner side of the arched end portion thereof into engagement with the positioning pin. Further, in the preferred embodiment, means is provided for feeding a series of speed lacers to the feed finger in the feed channel, and the feed finger is reciprocally operative in the feed channel for feeding sequential speed lacers to the positioning pin at the work station. Further, means is preferably provided for controlling the operation of the feed finger, the first and second die means, and the punch means, so that when a sheet is positioned in a desired orientation between the clamping discs of a speed lacer at the work station and the apparatus is manually actuated, the first and second die means operate to secure the speed lacer in the clamping position on the sheet, and then the punch means automatically operates to punch an aperture in the sheet, and so that as soon as the speed lacer is thereafter removed from the work station, the feed finger operates to advance a new speed lacer to the work station. Further, in the preferred embodiment, the controlling means comprises a depressible sensor pin mounted adjacent the work station and oriented so that when an assembled speed lacer is removed from the positioning pin, it engages and depresses the sensor pin to provide an indication of the removal of the assembled speed lacer from the positioning pin, and the controlling means is operative for controlling the feed finger so that it advances another speed lacer to the positioning pin whenever the sensor pin has been depressed. Still further, in the preferred embodiment, the first die means comprises a first die element and a first die actuating assembly comprising a first die piston and a first die cylinder for moving the first die element toward and away from the second die element, and a bore extends axially through both the first die element and the first die actuating assembly. The punch means preferably extends axially through the first die actuating assembly, and it comprises a punch element which travels in the bore in the first die element and a punch actuating assembly comprising a second die piston and a second die cylinder for moving the punch element toward and away from the second die element through the bore in the first die element. Still further, the second die actuating assembly is preferably disposed on the opposite side of the first die actuating assembly from the work station, and the punch element preferably extends through the first die actuating assembly.

The method of the instant invention comprises the steps of positioning a speed lacer in a predetermined orientation on a sheet, engaging the clamping discs of the speed lacer with a pair of dies to deform it to a clamping position wherein the clamping discs thereof are in clamping engagement with the sheet, punching an aperture in the sheet which is aligned with the apertures in the clamping discs, the punching operation being carried out utilizing a punch which is operative through one of the dies while the dies are still in engagement with the clamping discs of the speed lacer, and disengaging the dies and the punch from the speed lacer and the sheet. Accordingly, the method of the instant invention can be carried out at a single work station, and it can be effectively utilized for assembling speed lacers on sheets, such as the lacing strips of boots or the like. After the method has been completed, a rivet or the like may be assembled in the aperture in the clamping discs and the sheet in accordance with heretofore-known methods in order to permanently secure the speed lacer to the sheet.

It is seen, therefore, that the apparatus and method of the instant invention can be effectively utilized for securing speed lacers on sheets such as the lacing strips of boots. Further, since a speed lacer can be secured on a sheet and an aperture which is aligned with the apertures in the clamping discs of the speed lacer can be punched in the sheet at the same work station, substantial reductions in the amount of time and expense required to assemble the speed lacer on the sheet are realized when the method and apparatus of the instant invention are utilized. Further, since the apparatus of the instant invention utilizes highly-effective and accurate positioning means for positioning speed lacers at a work station, it can be effectively automated for rapid assembly operations, wherein as soon as a first speed lacer has been assembled on a sheet and the sheet and the speed lacer have been removed from the work station, a second speed lacer is fed to the work station to be assembled on the sheet.

Accordingly, it is a primary object of the instant invention to provide an effective apparatus for assembling a speed lacer on a sheet prior to the assembly of a rivet in the speed lacer.

Another object of the instant invention is to provide an effective apparatus for assembling speed lacers on boots.

An even further object of the instant invention is to provide an apparatus for assembling a speed lacer on a sheet prior to the assembly of a rivet in the speed lacer, wherein the speed lacer is moved into a position of clamping engagement with the sheet, and an aperture is punched in the sheet which is aligned with the apertures in the clamping discs of the speed lacer at a single work station.

An even further object of the instant invention is to provide an effective method of assembling a speed lacer on a sheet.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
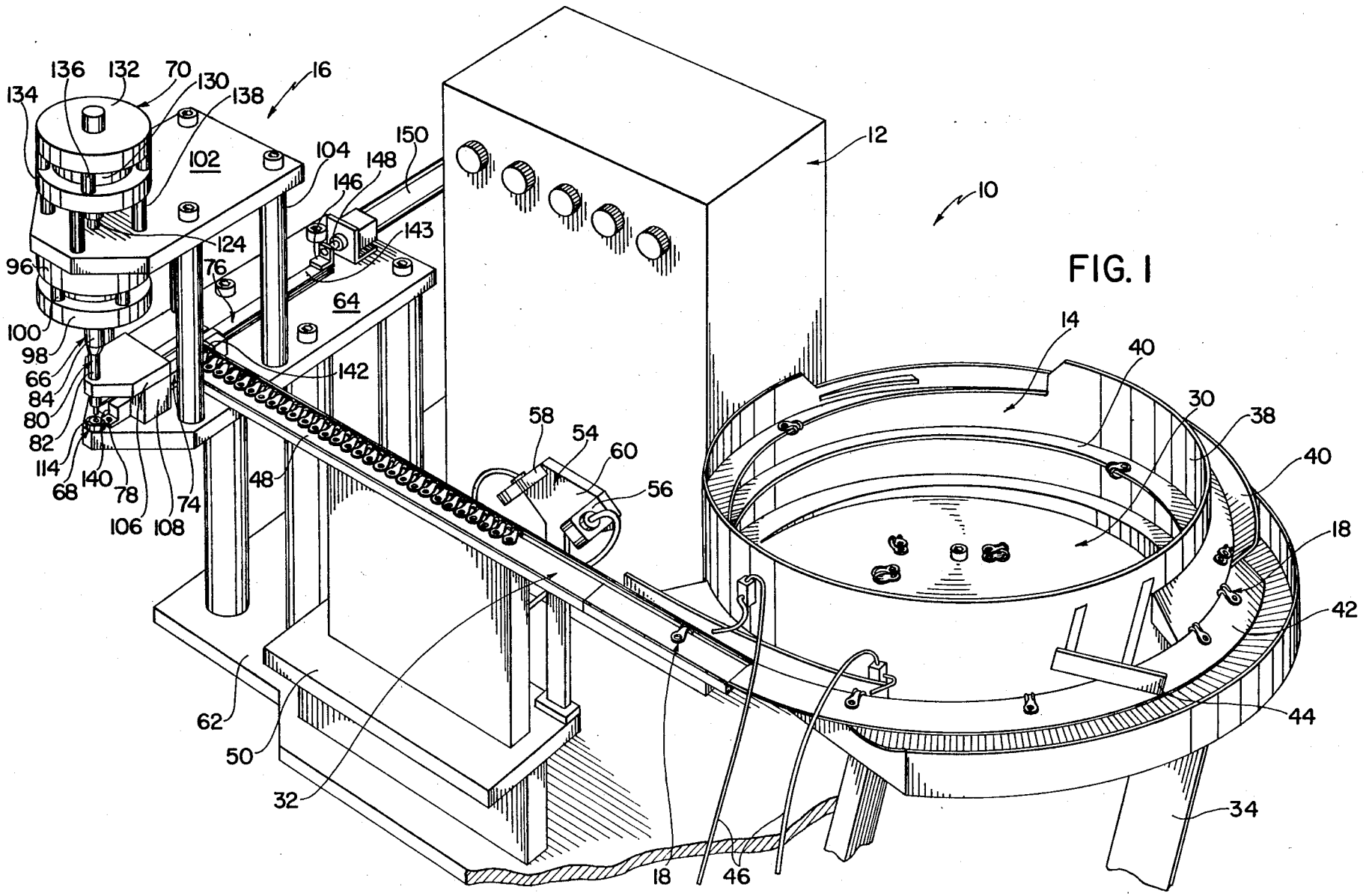
FIG. 1 is a perspective view of the apparatus of the instant invention.

Referring now to the drawings, the apparatus of the instant invention is illustrated in FIG. 1 and generally indicated at 10, and it comprises a control unit generally indicated at 12, a feeder unit generally indicated at 14, and an assembly unit generally indicated at 16. The apparatus 10 is operative for assembling speed lacers of the type generally indicated at 18 in FIG. 2 on sheets, such as the lacing strips of boots. More specifically, the feeder unit 14 is operative for feeding speed lacers 18 to the assembly unit 16 where the speed lacers 18 are assembled on sheets, such as the lacing strips of boots, and the control unit 12 is operative for controlling the operation of the feeder unit 14 and the assembly unit 16 for assembling the speed lacers 18 on sheets in rapid succession.

Figure 2:
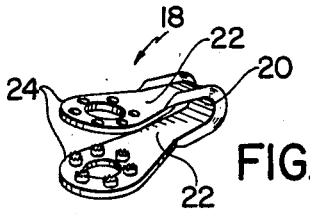
FIG. 2 is an enlarged perspective view of a speed lacer.

Referring first to FIG. 2, a speed lacer 18 is clearly illustrated. As will be seen, the speed lacer 18 is of generally U-shaped configuration, and it comprises an arch-shaped end portion 20 and a pair of spaced legs 22 which extend from the arch-shaped end portion 20 terminating in spaced, substantially parallel, substantially circular apertured clamping discs 24. The speed lacer 18 is preferably made of a suitable metal, and it is deformable to a position wherein the clamping discs 24 thereof are in clamping engagement with opposite sides of a sheet of material received therebetween. In this connection, the speed lacer 18 is particularly effective when it is utilized in a lacing assembly for a boot 26 of the type illustrated in FIGS. 5 through 8. In this regard, a plurality of the speed lacers 18 are preferably assembled on the lacing strip portions 28 of the boot 26 where lacing eyelets are normally provided, the speed lacers 18 being assembled so that the legs 22 and the arch-shaped end portions 20 thereof project outwardly from the edge of the lacing strip 28 to define a plurality of loops therealong.

The feeder unit 14 comprises a conventional vibratory feeder drum generally indicated at 30 and a conventional vibratory feeder track or "incline" generally indicated at 32 which extends from the feeder drum 30 to the assembly unit 16. The feeder drum 30 is supported on a stand 34, and it is of substantially circular configuration, and it comprises a bottom wall 36, a substantially circular side wall 38, and a speed-lacer track 40 which extends in spiraling relating from the bottom wall 36 along the interior of the side wall 38 and then a distance along the exterior of the side wall 38 to a substantially flat rail 42 which extends to the "inline" 32. The feeder unit 14 further comprises means (not shown) for vibrating the vibratory feeder drum 30 so that speed lacers which are received on the bottom wall 36 travel on the track 40 and then fall onto the rail 42 with the clamping discs 24 of the speed lacers 18 disposed on opposite sides of the rail 42. A knockdown arm 44 is provided on the vibratory feeder drum 30 adjacent the rail 42 for reorienting speed lacers which are incorrectly received on the rail 42, and a pair of air jets 46 are provided for advancing the speed lacers 18 from the rail 42 to the "inline" 32. The "inline" 32 comprises an inline track 48 which is mounted on a frame 50, a sensor unit 54, and means (not shown) for vibrating the inline track 48 to advance the speed lacers 18 therealong. The sensor unit 54 comprises a light source 56 and a photocell 58 which are mounted on a frame 60. In this connection, the light source 56 and the photocell 58 are cooperatively positioned relative to the inline track 48, so that when there are no speed lacers 18 on the adjacent portion of the track 48, light from the light source 56 reflects off the adjacent portion of the track 48 and is received by the photocell 58. However, since the speed lacers 18 are of irregular configuration, when a speed lacer 18 is positioned in the path of the light from the light source 56, the light is randomly deflected so that it does not fall on the photocell 58. Hence, in this manner, the sensor unit 54 is operative for sensing whether or not the track 48 is filled with speed lacers 18. The stand 60 is mounted on the frame 50 so that the sensor unit 54 is spaced from the assembly unit 16 as illustrated; and the frame 50, the feeder drum stand 34, the control unit 12, and the assembly unit 16 are all preferably mounted on a common table 62.

Figure 3:
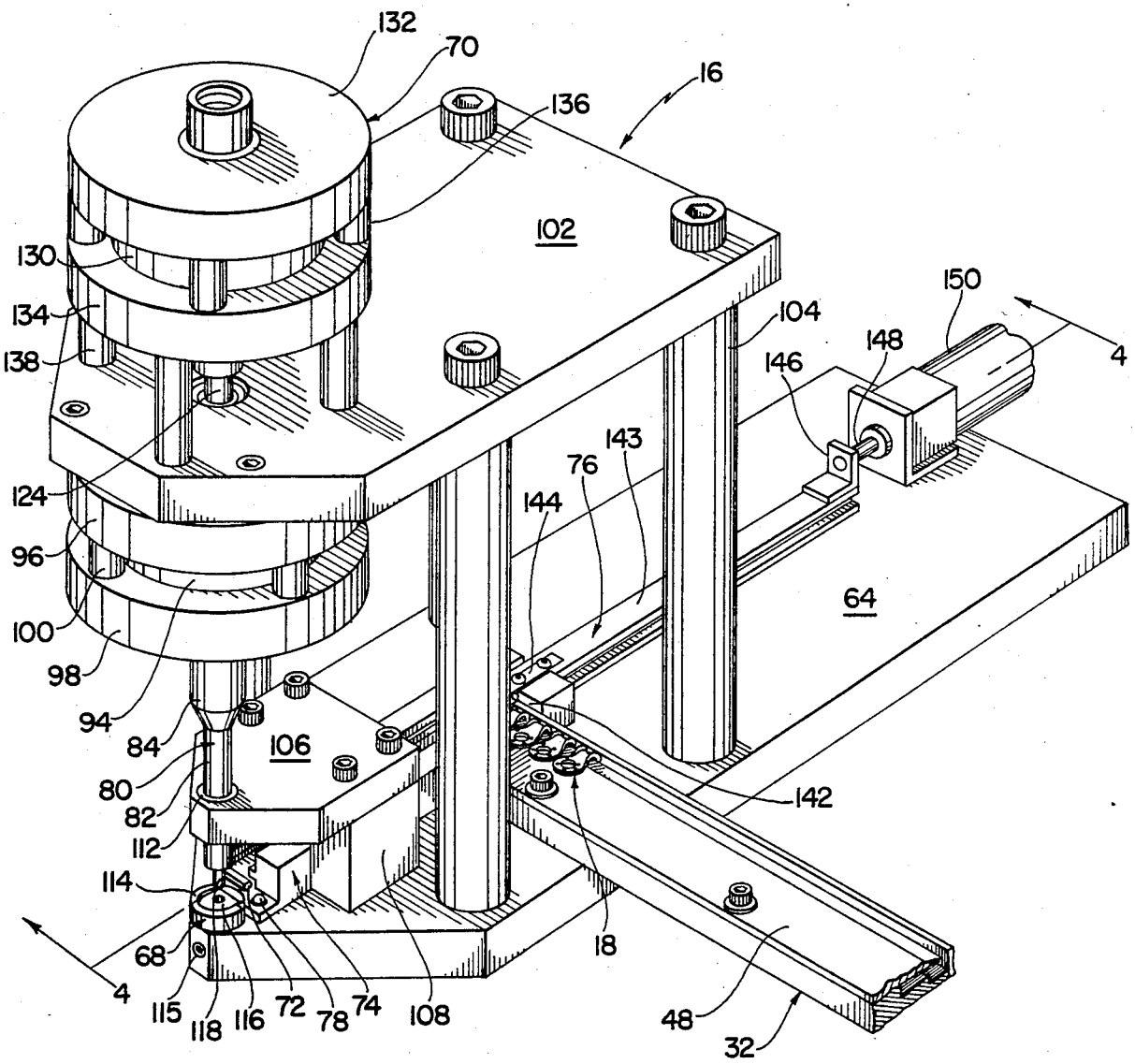
FIG. 3 is an enlarged perspective view of the assembly unit of the apparatus.
Figure 4:
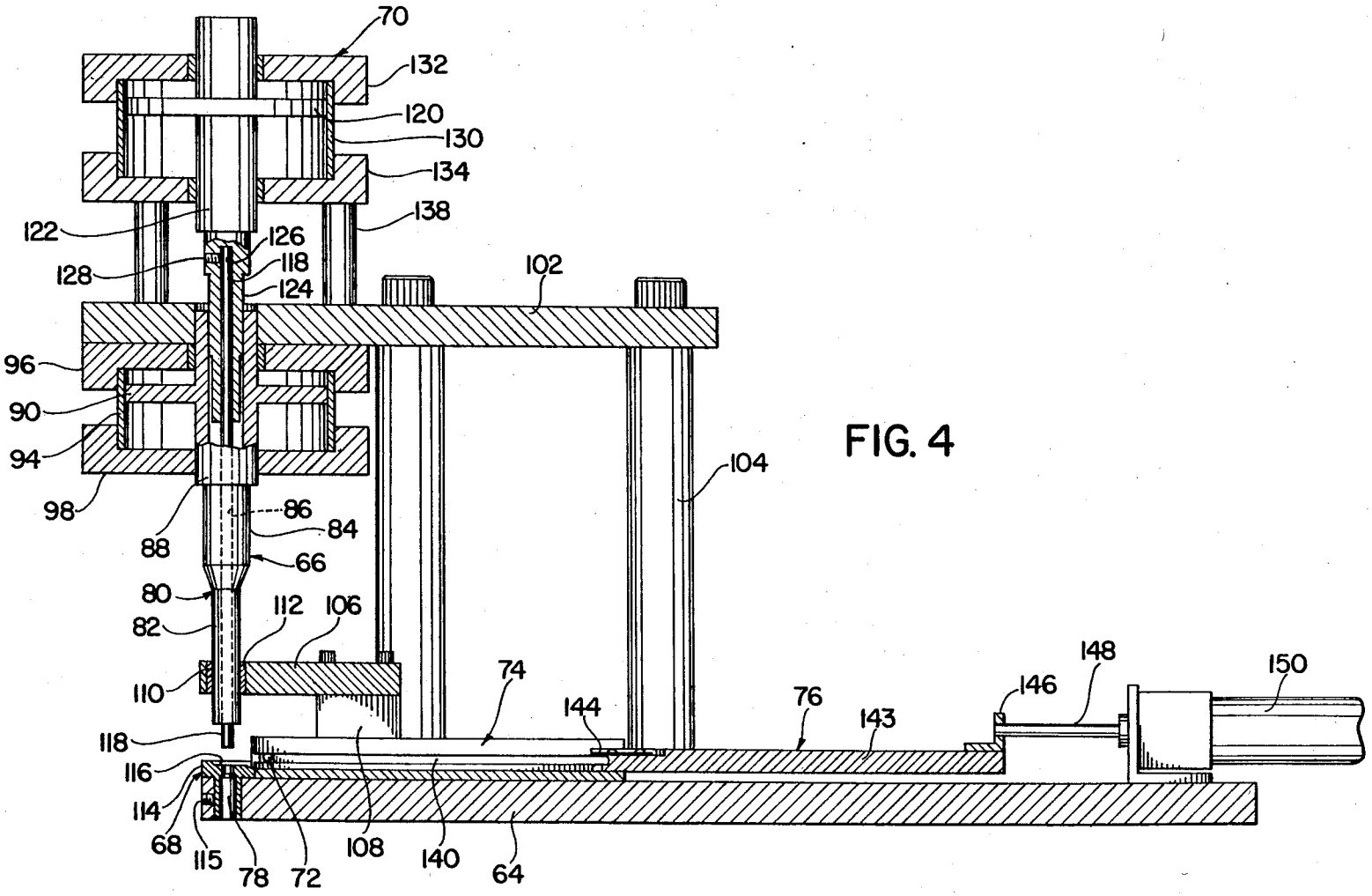
FIG. 4 is a sectional view taken along line 4—4 in FIG. 3.

Referring now to FIGS. 3 and 4, the assembly unit 16 is more clearly illustrated. The assembly unit 16 comprises a base 64, a first or movable die assembly generally indicated at 66, a second or stationary die assembly generally indicated at 68, a punch assembly generally indicated at 70, an alignment pin 72, a feed-block generally indicated at 74, a feed-finger assembly generally indicated at 76, and a sensor switch comprising a sensor pin 78. During operation of the assembly unit 16, speed lacers 18 are advanced thereto on the inline track 48, and they are individually assembled on sheets such as the lacing strips 28 of boots. In this connection, the assembly unit 16 is operative for deforming each speed lacer 18 to a position wherein the clamping discs 24 thereof are in clamping engagement with the opposite sides of a sheet and for thereafter punching an aperture in the sheet which is aligned with the apertures in the clamping discs 24. The speed lacer 18 and the sheet can then be removed from the assembly unit 16 so that a rivet can be assembled through the apertures in the clamping discs 24 and the sheet in order to permanently secure the speed lacer 18 to the sheet.

The movable die assembly 66 comprises an elongated cylindrical die element generally indicated at 80 having an elongated, reduced lower portion 82 and an enlarged upper portion 84, and an axial bore 86 extends through both the lower portion 82 and the upper portion 84. The upper portion 84 is connected to a piston shaft 88 which is integrally formed with a piston 90, and an enlarged axial bore 92 extends through both the piston shaft 88 and the piston 90. The piston 90 and the piston shaft 88 are received within a circular cylinder wall 94 having upper and lower cylinder heads 96 and 98 which cooperate with the wall 94 to define a pneumatic cylinder in which the piston 90 travels for axially moving the die element 80 toward and away from the stationary die assembly 68. The cylinder heads 96 and 98 are connected to the control unit 12 through pneumatic lines (not shown), they are maintained in assembled relation with the cylinder wall 94 by means of a plurality of assembly posts 100, and the upper cylinder head 96 is secured on a mounting plate 102 which is mounted in upwardly spaced relation to the base 64 on a plurality of vertical columns 104. Also included in the movable die asssembly 66 is an alignment plate 106 which is mounted on a mounting block 108 on the base 64, the alignment plate 106 having an aperture 110 therein containing a bushing 112 through which the lower portion 82 of the die element 80 travels.

The second or stationary die assembly 68 comprises a second die element 114 which is received in an aperture in the base 64 and secured therein with a set screw 115. Formed in the die element 114 is a recess 116 which is dimensioned and configured to receive a clamping disc 24 of a speed lacer 18 therein and which is aligned with the terminal end of the lower portion 82 of the die element 80.

The punch assembly 70 comprises an elongated punch element 118 which is received and travels in coaxial relation in the bore 86 in the die element 80. The punch assembly 70 further comprises a piston 120 to which a piston shaft 122 is integrally attached, and a reduced shaft 124 extends from the piston shaft 122. A bore 126 extends through the piston shaft 124 for mounting the punch element 118 therein, and the punch element 118 is secured therein by means of a set screw 128. The punch assembly 70 further comprises a cylinder wall 130 in which the piston 120 travels, and upper and lower cylinder heads 132 and 134 are assembled on the opposite ends of the cylinder wall 130 so that they cooperate therewith to define a pneumatic actuating cylinder for the punch element 118. The piston heads 132 and 134 are secured in assembled relation with a plurality of assembly posts 136, and a plurality of columns 138 extend between the lower piston head 134 and the plate 102 for mounting the punch assembly 70 thereon. The upper and lower piston heads 132 and 134 are connected to the control unit 12 through pneumatic lines (not shown) for supplying pressurized air to the punch assembly 70 to effect and control the movement of the piston 120 in the cylinder 130.

The feed block 74 is mounted on the base 64, and an elongated feed channel 140 is formed therein so that it extends rearwardly from a point adjacent the second die assembly 68, the channel 140 being dimensioned and configured for receiving speed lacers 18 therein so that they can be advanced to a point adjacent the second die assembly 68. Formed in the rear portion of the feed block 74 is an opening 142 through which the inline track 48 extends for supplying speed lacers 18 to the channel 140.

The positioning pin 72 extends from the forward portion of the feed block 74 in substantially transverse relation to the channel 140 so that it is positioned in front thereof for receiving speed lacers 18 from the channel 140. In this connection, the positioning pin 72 is oriented to received individual speed lacers 18 from the channel 140 so that the clamping discs 24 of each speed lacer 18 pass on opposide sides of the pin 72 and so that when the speed lacer 18 is moved forwardly until the inner side of the arch-shaped end portion 20 thereof engages the pin 72, the speed lacer 18 is held in an aligned position wherein the clamping discs 24 of the speed lacer 18 are substantially aligned with the recess 116 and the die element 80 and so that the lowermost clamping disc 24 is received in the recess 116.

The feed finger 76 comprises an elongated feed member 143 which is dimensioned and configured to travel in the channel 140 in the feed block 74 and a speed lacer retainer clip 144 which is secured on the forward portion of the upper side of the feed member 143. An arm 146 extends upwardly from the rear end of the feed member 143, and it is connected to a shaft 148 of an air cylinder 150 which is controlled with the control unit 12 for moving the feed member 143 forwardly and rearwardly in the channel 140 to advance sequential speed lacers therein.

The sensor pin 78 is mounted in the forward portion of the feed block 74 adjacent the terminal end of the pin 72, and it comprises part of a resiliently depressible pneumatic switch which is connected to the control unit 12 through pneumatic lines (not shown). Accordingly, when the sensor pin 78 is depressed, an indication thereof is transmitted to the control unit 12.

The control unit 12 comprises a conventional programable pneumatic controller which is connected to the feeder unit 14, the movable die assembly 66, the punch assembly 70, the feed-finger assembly 76, and the sensor pin 78 through conventional pneumatic lines (not shown) for controlling the operation of the apparatus 10 in the manner hereinafter described.

During operation of the apparatus 10, the vibratory feeder unit 14 operates to pass speed lacers 18 along the rail 42 to the "inline" 32 where they are positioned and aligned in sideby-side relation and fed to the assembly unit 16. The sensor unit 54 operates to determine whether the portion of the inline track 48 which extends from the feed block 74 to the frame 60 is filled with speed lacers 18 by sensing whether or not light from the lighting element 56 is reflected off the track 48 and received by the photocell 58. In this connection, when light is received by the photocell 58, the control unit 12 operates the vibratory drum 30 to advance additional speed lacers 18 to the "inline" track 42; whereas when the light from the lighting element 56 is not received by the photocell 58, the control unit 12 interrupts the operation of the vibratory feeder 30 so that no additional speed lacers 18 are advanced to the inline track 48. The speed lacers 18 on the track 48 are sequentially advanced through the opening 142 to the channel 140 in the feed block 74 where they are individually engaged by the feed finger 76 and advanced forwardly in the channel 140. In this connection, the channel 140 is dimensioned to receive individual speed lacers 18 therein whenever the feed finger 76 is moved rearwardly so that the forward end thereof is disposed adjacent the rear edge of the opening 142; and accordingly the feed-finger assembly 76 is operative for individually advancing speed lacers 18 to the alignment pin 72 whenever the feed finger 76 is moved forwardly in the channel 140. Specifically, when a speed lacer 18 is received in the channel 140, the forward end of the feed member 143 engages the speed lacer 18, and the clip 144 retains the speed lacer 18 down in the channel 140. The cylinder 150 is then operated through the control unit 12 to advance the feed member 143 forwardly in the channel 140 so that the speed lacer 18 is received on the positioning pin 72 with the positioning pin 72 received in the interior of the speed lacer 18. The feed member 143 then remains in a forward position of engagement with the speed lacer 18 to maintain it in an aligned position adjacent the second die assembly 68 so that a sheet, such as the lacing strip 28 of a boot 26, can be positioned between the clamping discs 24 of the speed lacer 18. In this manner, the control unit 12 is then operated by an operator of the apparatus 10 to actuate the first or movable die assembly 66 so that the die element 80 descends and engages the upper clamping disc 24 of the speed lacer 18 and to move the lower clamping disc 24 into pressurized engagement with the second die element 114. The first and second die assemblies 66 and 68 then cooperate to deform the speed lacer 18 to a position wherein the clamping discs 24 thereof are in clamping engagement with the sheet received therebetween. While the die element 80 is still in engagement with the upper clamping disc 24 of the speed lacer 18 to hold the speed lacer 18 in position on the sheet therebetween, the control unit 12 automatically actuates the punch assembly 70 so that the punch element 118 travels downwardly through the bore 86 in the first die element 80 to punch an aperture in the sheet which is aligned with the apertures in the clamping discs 24 of the speed lacer 18. Thereafter, the first die assembly 66 and the punch assembly 70 are disengaged from the assembled speed lacer 18 to permit it to be removed from the alignment pin 72. As the speed lacer 18 is removed from the alignment pin 72, it engages the sensor pin 78, and the sensor pin 78 sends a signal to the control unit 12 which indicates that a new speed lacer 18 can be advanced to the alignment pin 72.

Figure 5:
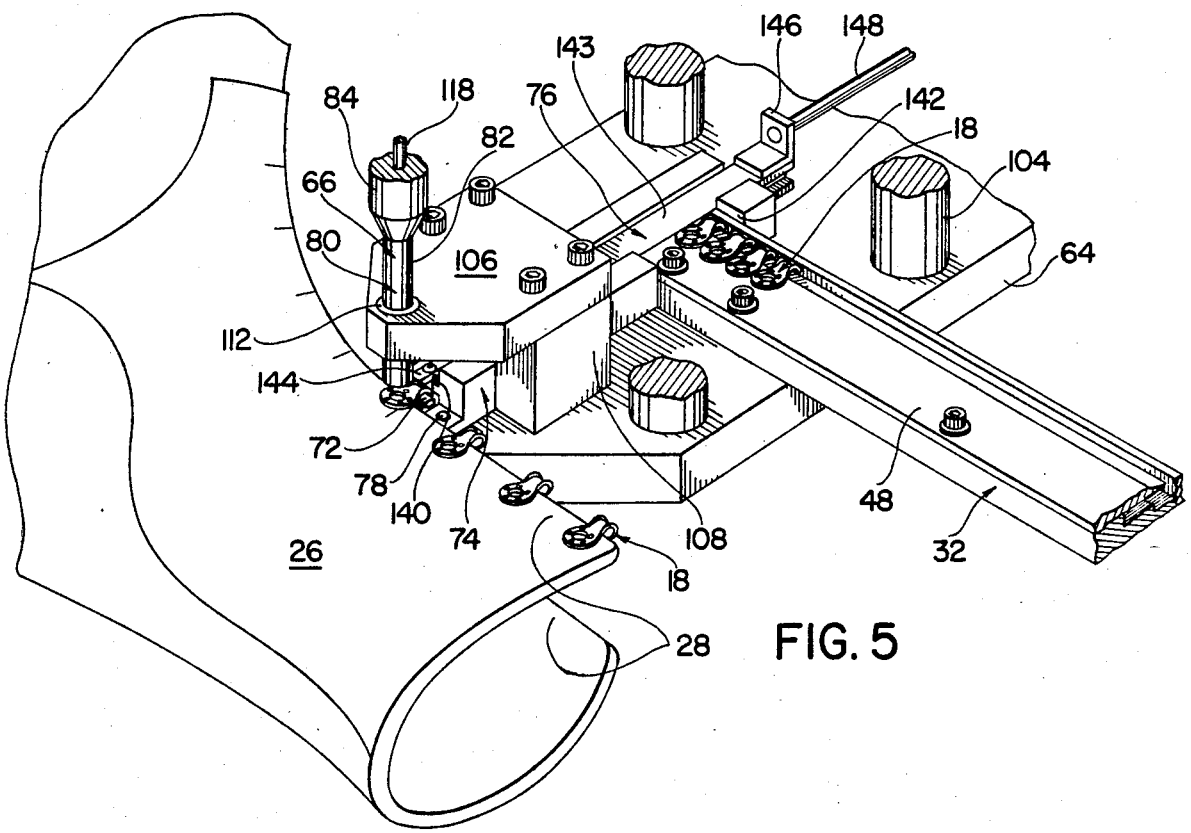
FIGS. 5 through 9 are sequential perspective views illustrating the operation of the assembly unit of the apparatus for assembling a speed lacer on a boot.
Figure 6:
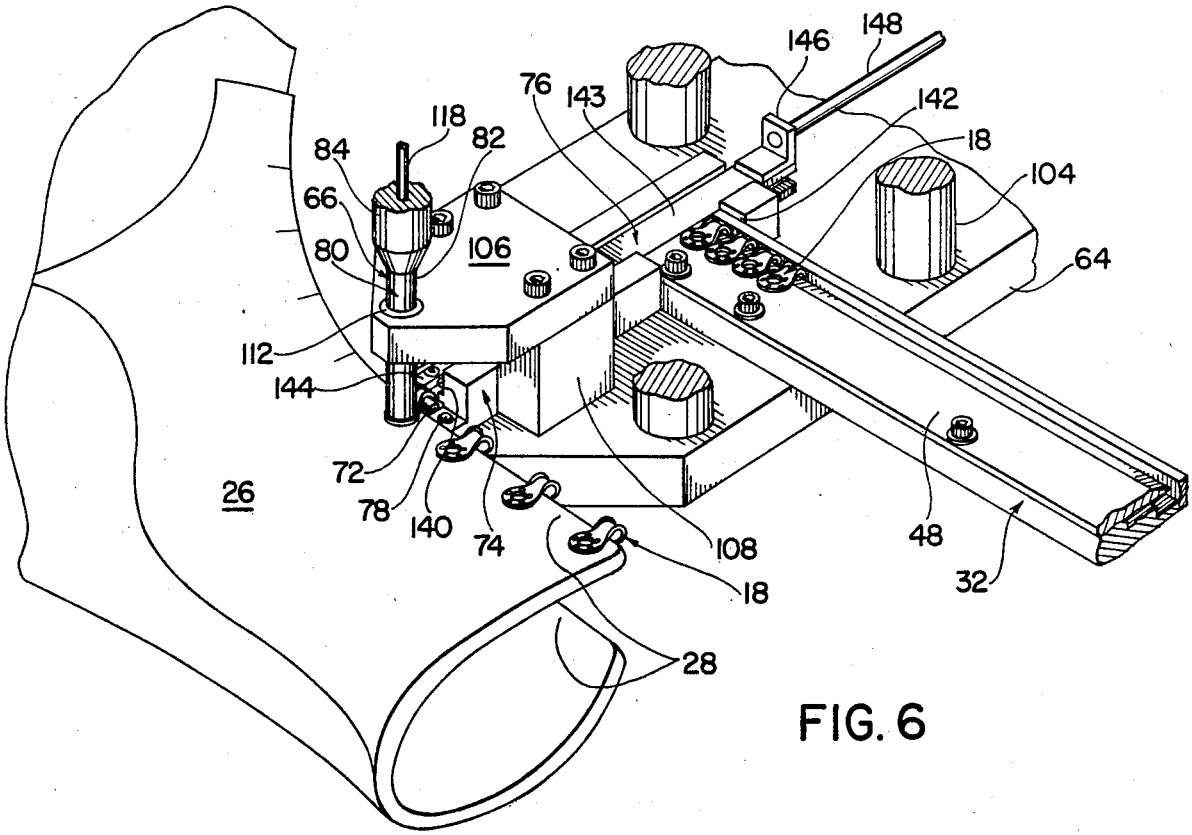
Figure 7:
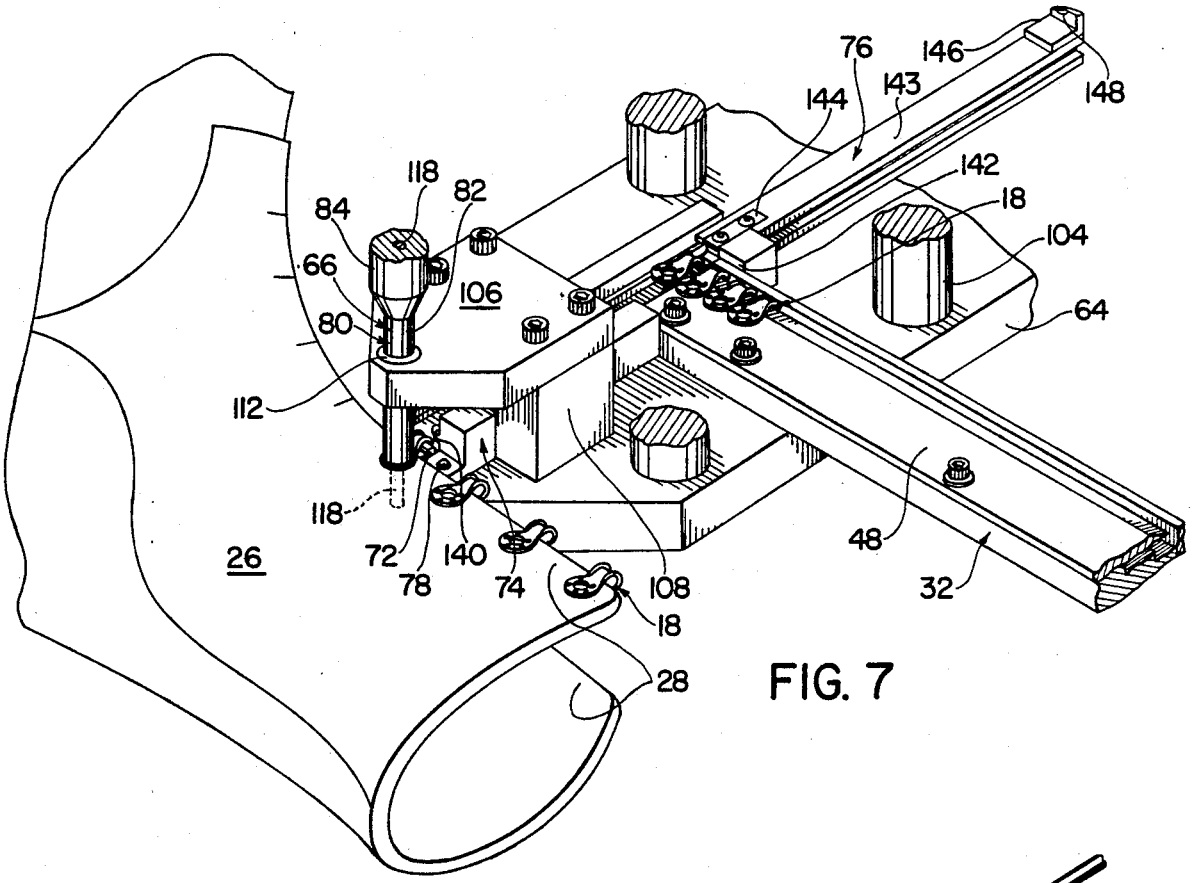
Figure 8:
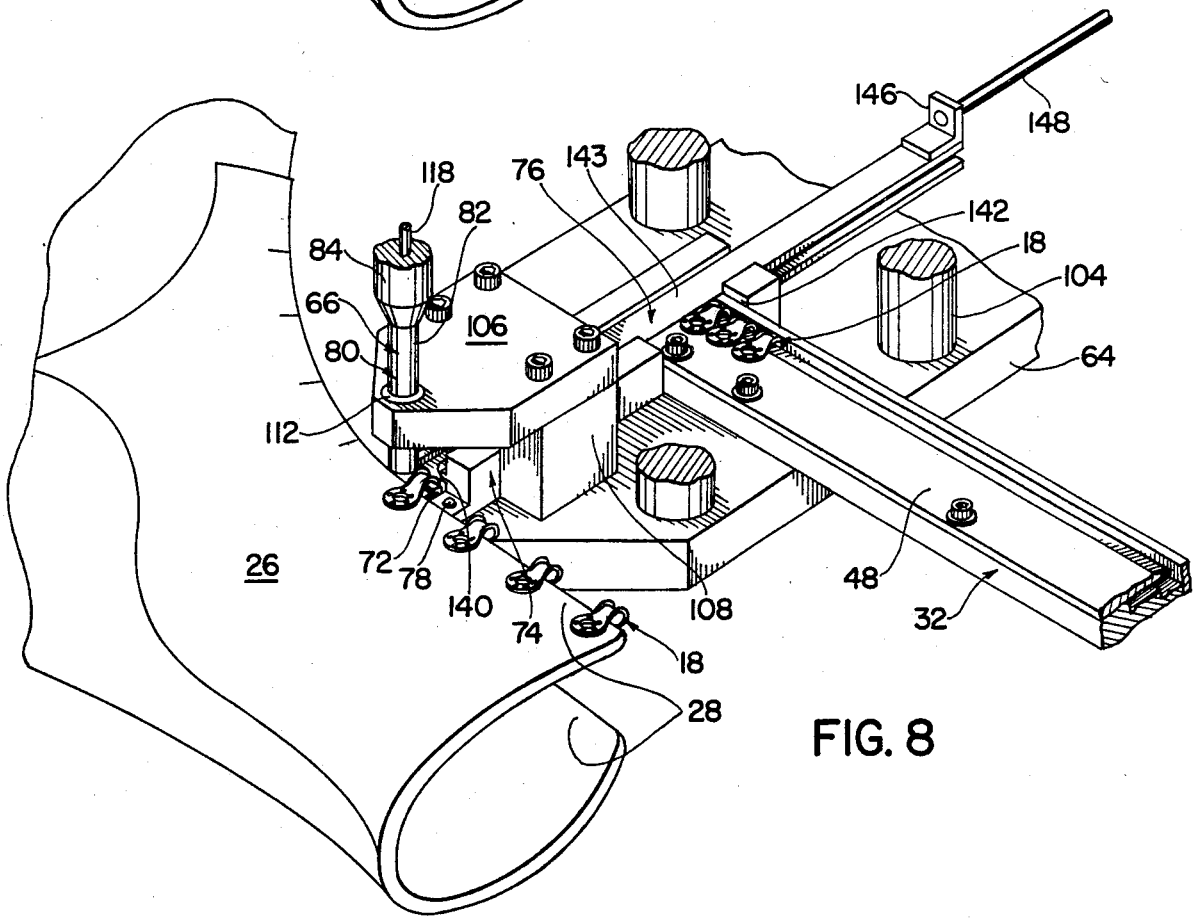
Figure 9:
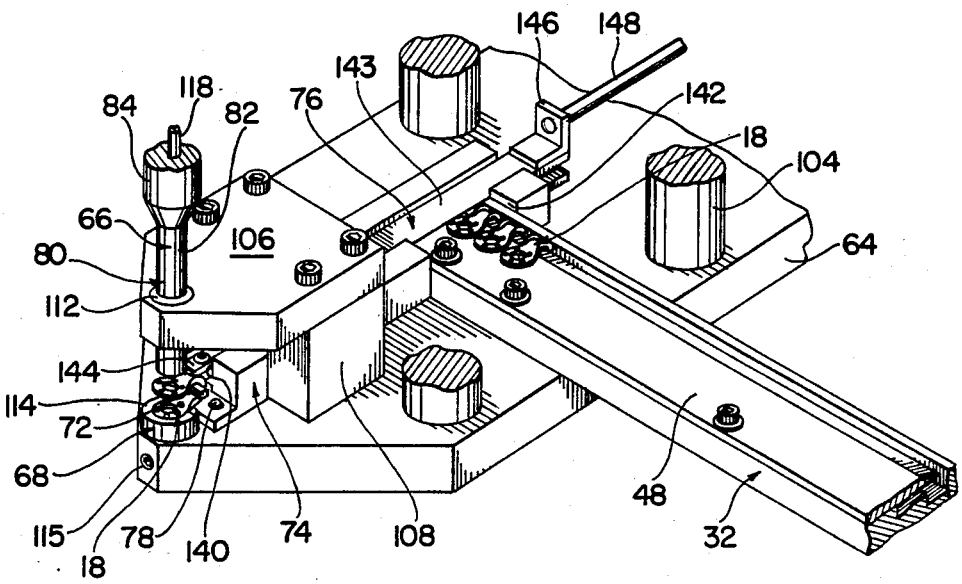

The sequential operation of the assembly unit 16 as it is operated by the control unit 12 in accordance with the method of the instant invention is illustrated in FIGS. 5 through 9. As illustrated in FIG. 5, a speed lacer 18 has been advanced to the alignment pin 72, and it is held in engagement therewith by the feed member 143 so that the lacing strip 28 of a boot 26 can be positioned between the forwardly extending clamping discs 24 of the speed lacer 18. When the apparatus 10 is thereafter actuated by an operator, it operates to automatically perform the sequence of operations illustrated in FIGS. 6 through 9. Specifically, as illustrated in FIG. 6, the die element 80 of the first die assembly 66 descends so that the clamping discs 24 of the speed lacer 18 are compressed between the die elements 80 and 114 to urge the clamping discs 24 into pressurized engagement with the lacing strip 28. Thereafter, as illustrated in FIG. 7, when the clamping discs 24 of the speed lacer 18 have been moved into clamping engagement with the lacing strip 28 of the boot 26, the punch assembly 70 is operated so that the punch element 118 descends to punch an aperture in the lacing strip 28 which is aligned with the apertures in the clamping discs 24. Simultaneously, the feed member 143 of the feed finger assembly 76 moves rearwardly to receive a new speed lacer 18 from the inline track 48. Thereafter, as illustrated in FIG. 8, the first die element 80 and the punch 118 are moved upwardly and disengaged from the speed lacer 18 which has been assembled on the lacing strip 28, and the feed member 143 of the feed finger assembly 76 is advanced forwardly in the channel 140 to an intermediate point therein so that the feed member 143 blocks the end of the inline track member 48 to prevent additional speed lacers 18 from moving into the channel 140. Thereafter, as the assembled speed lacer 18 is removed from the alignment pin 72, it engages the sensor pin 78 to provide an indication that a new speed lacer 18 can be advanced to the alignment pin 72. Accordingly, as illustrated in FIG. 9, after the assembled speed lacer 18 has been removed from the alignment pin 72, the feed member 143 is further advanced in the channel 140 to move a new speed lacer 18 into an aligned position on the alignment pin 72 so that it can be assembled at a different location on the lacing strip 28.

It is seen, therefore, that the instant invention provides a highly effective apparatus and method for assembling speed lacers 18 on sheets, such as the lacing strips 29 of boots 26, prior to permanently securing the speed lacers 18 with rivets. The apparatus 10 is operative for both assembling speed lacers on the lacing strips 28 of boots, such as the boots 26, and also for punching apertures in the lacing strips 28 which are aligned with the apertures in the clamping discs 24 of the speed lacers 18. Hence, the apparatus 10 is operative for performing two operations which have heretofore required separate operations at separate work stations. The apparatus 10 uses the alignment pin 72 for effectively aligning the speed lacers 18 at the work station, and the punching assembly 70 operates through the center of the movable die assembly 66 so that an effective means for both clamping and punching the speed lacers 18 is provided. Accordingly, it is seen that the apparatus and method of the instant invention represent significant advancements in the art which have substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A method of assembling a speed lacer on a sheet prior to the assembly of a rivet in said speed lacer, wherein the speed lacer is of generally U-shaped configuration and comprises an arch-shaped end portion and a pair of spaced legs which extend therefrom terminating in spaced, substantially parrallel apertured clamping discs, said method comprising:

a. positioning said speed lacer in a predetermined orientation on said sheet;

b. moving said speed lacer to a clamping position wherein the clamping discs thereof are in clamping engagement with said sheet by engaging said clamping discs with a pair of dies to deform said speed lacer to said clamping position;

c. punching an aperture in said sheet with a punch while said dies are still in engagement with said clamping discs, said punch being operative through one of said dies, said aperture being aligned with the apertures in said clamping discs; and d. removing said dies and said punch from said speed lacer and said sheet.

2. An apparatus for assembling a speed lacer on a sheet, wherein the speed lacer is of generally U-shaped configuration and comprises an arch-shaped end portion and a pair of spaced legs which extend therefrom terminating in spaced, substantially parallel, apertured clamping discs, said apparatus comprising:

a. means for receiving and positioning a speed lacer in an aligned position at a work station;

b. first and second die means engageable with the clamping discs of said speed lacer when said speed lacer is in said aligned position for urging said clamping discs together to deform said speed lacer to a clamping position wherein when said sheet is received between said clamping discs, said clamping discs clampingly engage opposite sides thereof, said first die means comprising a first die element and a first die actuating cylinder for moving said first die element toward and away from said second die element, said first die element having a bore which extends axially therethrough and which also extends through said first die actuating cylinder; and c. punch means operative through said first die means in substantially coaxial relation therewith when said first and second die means are in engagement with said clamping discs and said clamping discs are in said clamping position on said sheet for punching an aperture in said sheet which is aligned with the apertures in said discs, said punch means comprising a punch element which travels in said bore and a punch actuating cylinder for moving said punch element toward and away from said second die means through said bore, said punch actuating cylinder being disposed on the opposite side of said first die actuating cylinder from said work station.

3. An apparatus for assembling a speed lacer on a sheet, wherein the speed lacer is of generally U-shaped configuration and comprises an arch-shaped end portion and a pair of spaced legs which extend therefrom terminating in spaced, substantially parallel, apertured clamping discs, said apparatus comprising:

a. means engageable with the arch-shaped end portion of a speed lacer for receiving and positioning the speed lacer in an aligned position at a work station;

b. first and second die means engageable with the clamping discs of said speed lacer when said speed lacer is in said aligned position for urging said clamping discs together to deform said speed lacer to a clamping position wherein when said sheet is received between said clamping discs, said clamping discs clampingly engage opposite sides thereof; and c. punch means operative through said first die means when said first and second die means are in engagement with said clamping discs and said clamping discs are in said clamping position on said sheet for punching an aperture in said sheet which is aligned with the apertures in said discs.

4. In the apparatus of claim 3, said first die means and said punch means being coaxially disposed and traveling in coaxial relation to assemble said spaced lacer on said sheet.

5. In the apparatus of claim 3, said means engagable with the arch-chaped end portion further characterized as being engageable with the inner side of the arch-shaped end portion of a speed lacer.

6. An apparatus for assembling a speed lacer on a sheet, wherein the speed lacer is of generally U-shaped configuration and comprises an arch-shaped end portion and a pair of spaced legs which extend therefrom terminating in spaced, substantially parallel, apertured clamping discs, said apparatus comprising:

a. means for receiving and positioning a speed lacer in an aligned position at a work station, including a positioning pin at said work station for receiving said speed lacer thereon, and means engageable with said speed lacer for urging the inner side of the arch-shaped end portion thereof into engagement with said positioning pin to thereby position said speed lacer in an aligned position at said work station;

b. first and second die means engageable with the clamping discs of said speed lacer when said speed lacer is in said aligned position for urging said clamping discs together to deform said speed lacer to a clamping position wherein when said sheet is received between said clamping discs, said clamping discs clampingly engage opposite sides thereof; and c. punch means operative through said first die means when said first and second die means are in engagement with said clamping discs and said clamping discs are in said clamping position on said sheet for punching an aperture in said sheet which is aligned with the apertures in said discs.

7. The apparatus of claim 3 further comprising a feed block having a feed channel therein, said feed channel extending to said work station, said means engageable with said speed lacer comprising a feed finger slidably received in said feed channel and operative for advancing a speed lacer in said feed channel to said work station so that it is received and positioned in said aligned position on said pin.

8. In the apparatus of claim 7, said feed finger being reciprocally operative in said feed channel for individually feeding a sequential series of speed lacers to said work station so that they are received on said pin in said aligned position, said apparatus further comprising means for feeding said series of speed lacers to said feed finger so that they are positioned to be received on said pin when they are advanced thereto through said channel with said feed finger, and means for controlling the operation of said feed finger, said first and second die means and said punch means to that after said first and second die means and said punch means have been operated to assemble a speed lacer on the sheet and to punch an aperture in the sheet, and the assembled speed lacer has been removed from said work station, said feed finger advances a new speed lacer to said work station.

9. In the apparatus of claim 8, said controlling means comprising a sensor means adjacent said work station for sensing the removal of an assembled speed lacer therefrom.

10. In the apparatus of claim 9, said sensor means comprising a depressible sensor pin mounted adjacent said work station and positioned so that when an assembled speed lacer is removed from said positioning pin, it engages and depresses said sensor pin to provide an indication of the removal of said assembled speed lacer from said positioning pin.

* * * * *